US009581304B2

(12) United States Patent
Carlén

(10) Patent No.: US 9,581,304 B2
(45) Date of Patent: Feb. 28, 2017

(54) EASILY MOUNTABLE LIGHTING LUMINAIRE WITH FITTING ARRANGEMENT

(71) Applicant: Strihl Scandinavia AB, Kungsbacka (SE)

(72) Inventor: Rikard Carlén, Kungsbacka (SE)

(73) Assignee: Strihl Scandinavia AB, Kungsbacka (SE)

( * ) Notice: Subject to any disclaimer, the term of this patent is extended or adjusted under 35 U.S.C. 154(b) by 263 days.

(21) Appl. No.: 14/375,723

(22) PCT Filed: Jan. 31, 2013

(86) PCT No.: PCT/SE2013/050085
§ 371 (c)(1),
(2) Date: Jul. 30, 2014

(87) PCT Pub. No.: WO2013/115722
PCT Pub. Date: Aug. 8, 2013

(65) Prior Publication Data

US 2015/0049462 A1 Feb. 19, 2015

(30) Foreign Application Priority Data

Feb. 1, 2012 (SE) ..... 1250071
Oct. 1, 2012 (SE) ..... 1251100

(51) Int. Cl.
*H01R 33/00* (2006.01)
*F21S 8/08* (2006.01)
(Continued)

(52) U.S. Cl.
CPC ..... *F21S 8/086* (2013.01); *F21V 21/002* (2013.01); *F21V 21/30* (2013.01); *F21V 23/023* (2013.01);
(Continued)

(58) Field of Classification Search
CPC ..... F21V 21/002; F21V 21/30; F21V 23/023; F21V 23/06; F21W 2131/103; F21S 8/086
See application file for complete search history.

(56) References Cited

U.S. PATENT DOCUMENTS 5,941,632 A 8/1999 Wedell et al.
7,950,821 B1 * 5/2011 Georgitsis ..... B60Q 1/0483 362/217.12
(Continued)

FOREIGN PATENT DOCUMENTS

CH 424983 A 11/1966
DE 1171080 B 5/1964
(Continued)

OTHER PUBLICATIONS

Extended European Search Report received for European Patent Application No. 13742909.8, mailed on Aug. 21, 2015, 8 pages.
(Continued)

*Primary Examiner* — Evan Dzierzynski
(74) *Attorney, Agent, or Firm* — Morrison & Foerster LLP

(57) ABSTRACT

A lighting device for outdoor use comprising a lighting body and a socket body, where the lighting body comprises a lighting unit, a first electrical connection and a first locking member. The socket body comprises a second electrical connection and a second locking member, wherein the first and second electrical connections are arranged to connect to each other in a closed position in order supply the lighting unit with power. The first locking member and the second locking member are arranged for locking and unlocking the lighting body to the socket body in said closed position. The lighting body comprises a first fastening device and the socket body comprises a second fastening device, wherein the fastening devices are arranged to. The lighting body
(Continued)

comprises a first guiding means and the socket body comprises a second guiding means, which are arranged to interact.

15 Claims, 12 Drawing Sheets

(51) Int. Cl.

| | |
|---|---|
| ***F21V 21/30*** | (2006.01) |
| ***F21V 23/02*** | (2006.01) |
| ***F21V 23/06*** | (2006.01) |
| ***F21V 21/002*** | (2006.01) |
| ***F21V 25/04*** | (2006.01) |
| *F21V 21/116* | (2006.01) |
| *F21W 131/103* | (2006.01) |

(52) U.S. Cl.
CPC ..... *F21V 23/06* (2013.01); *F21V 25/04* (2013.01); *F21V 21/116* (2013.01); *F21W 2131/103* (2013.01)

(56) References Cited

U.S. PATENT DOCUMENTS

| | | | | |
|---|---|---|---|---|
| 2011/0149582 | A1* | 6/2011 | McKee | F16M 11/06 362/382 |
| 2011/0310613 | A1* | 12/2011 | Evans | A61M 21/02 362/272 |

FOREIGN PATENT DOCUMENTS

| | | | |
|---|---|---|---|
| DE | 3910191 | C1 | 7/1990 |
| EP | 818653 | A2 | 1/1998 |
| EP | 1788304 | A2 | 5/2007 |
| EP | 2177819 | A1 | 4/2010 |
| JP | 6-203616 | A | 7/1994 |
| JP | 10-92212 | A | 4/1998 |
| JP | 11-512873 | A | 11/1999 |
| JP | 2002-93208 | A | 3/2002 |
| WO | 84/01013 | A1 | 3/1984 |
| WO | 2004/076918 | A2 | 9/2004 |
| WO | 2010/028423 | A1 | 3/2010 |
| WO | 2010/049529 | A1 | 5/2010 |
| WO | 2011/153761 | A1 | 12/2011 |
| WO | 2012/167320 | A1 | 12/2012 |

OTHER PUBLICATIONS

International Search Report and Written Opinion received for PCT Patent Application No. PCT/SE2013/050085, mailed on May 2, 2013, 13 pages.

International Preliminary Report on Patentability received for PCT Patent Application No. PCT/SE2013/050085, mailed on Feb. 18, 2014, 6 pages.

Office Action recieved for Japanese Patent Application No. 2014-555530, mailed on Sep. 16, 2016, 5 pages (3 pages of English Translation and 2 pages of Official Copy).

Office Action received for European Patent Application No. 13742909.8, mailed on Nov. 22, 2016, 4 pages.

* cited by examiner

EASILY MOUNTABLE LIGHTING LUMINAIRE WITH FITTING ARRANGEMENT

CROSS REFERENCE TO RELATED APPLICATIONS

This application is a U.S. National Phase patent application of PCT/SE2013/050085, filed on Jan. 31, 2013, which claims priority to Swedish Patent Application No. 1250071-6, filed on Feb. 1, 2012, and Swedish Patent Application No. 1251100-2, filed on Oct. 1, 2012, the entire contents of which are incorporated herein by reference.

FIELD OF THE INVENTION

The present invention relates to a lighting device for outdoor use comprising a lighting body and a socket body, where the lighting body is adapted to be easily arranged on the socket body using guiding means and fastening devices for easy mounting and dismounting.

BACKGROUND OF THE INVENTION

Replacement of light bulbs in street light fittings are traditionally handled by a person that is lifted to the street light fitting in a man lift or similar and by hand opens up the light fitting and next replaces the light bulb. This is problematic in several aspects.

The most obvious aspect is the risk that the person performing this operation is exposed to as the work is carried out at significant height. Another problem with having personnel lifted at height in the vicinity of lampposts is, in those cases these lampposts are found in the vicinity of overhead lines, that overhead lines generally are uninsulated and thus are highly dangerous to come into contact with. This represents an additional significant risk.

In addition to the work being carried out at height, the work with lampposts involves further problems since the lampposts are not completely fixed. The strain that lampposts are exposed to from weather and wind in addition to the facts that they are very tall and that the street light fitting often has a considerable weight makes them swaying by nature. This results in that the lamppost itself in many cases may not provide support at e.g. replacement of street light fittings.

In addition, the operation of replacing the lighting unit/bulb or the entire street light fitting requires a relatively long period of time since the person that performs the work has to be lowered down between each operation, when the man lift or similar is moved between the lampposts. In most cases, the man lift or similar has to be driven on the roadway, or the like, that the street lighting is intended to illuminate. This unit is usually very slow and requires much space on the roadway, which is problematic since the man lift or similar, and also the person that performs the work and has to move between the man lift and the driver's seat, risk to get hit. For the personnel, it is especially dangerous if the stationary man lift or similar gets hit in the raised position. Additionally, the traffic and the traffic flow may be adversely affected by the presence of the man lift, which may increase the risk of other accidents.

In order to minimize the impact on traffic, the work is advantageously performed during evening and night time, which is not always preferable from the view of the performing personnel.

All this implies that the time required for replacing a lighting unit/bulb, or the entire street light fitting, should be kept to an absolute minimum.

A first step in minimizing the time required for replacing lighting unit/bulb is to replace a larger unit than just the lighting unit/bulb. A larger unit may often be made more robust than just a lighting unit/bulb and may be specifically adapted to be easy to mount and dismount.

SUMMARY OF THE INVENTION

The object of the invention is to provide an alternative procedure for assembly of lighting devices outdoors, especially street lighting situated at height which poses great demands on the light fitting's ability to resist moisture, wind and other external stress. The inventive lighting device is designed to withstand this. Lighting devices for outdoor use pose special demands e.g. with regard to the possibility of easy and time efficient assembly and disassembly.

The solution to the problem according to the invention is described in the characterizing part of claim. Further claims are directed to advantageous embodiments and further developments of the invention.

The above mentioned problem is solved by using a lighting device for outdoor use comprising a lighting body and a socket body. The lighting body comprises a lighting unit, a first electrical connection and a first locking member. The socket body comprises a second electrical connection and a second locking member, wherein the first and second electrical connections are arranged to connect to each other in a closed position in order to supply the lighting unit with power and further wherein the first locking member and the second locking member are arranged for locking and unlocking the lighting body to the socket body in said closed position. The closed position involves the lighting body being locked to the socket body by the first and the second locking members. In the closed position, the lighting body is substantially parallel to the socket body. Further, the inventive lighting device is characterized in that the lighting body comprises a first fastening device and the socket body comprises a second fastening device. These first and second fastening devices are arranged to interact at least at connection of the lighting body to the socket body by in a first open position allowing a rotational relative motion between the lighting body and the socket body both in azimuth direction and elevation direction, and by simultaneously locking a relative motion between the lighting body and the socket body in longitudinal direction. Further, the lighting body comprises a first guiding means and the socket body comprises a second guiding means, which first and second guiding means are arranged to interact at least at connection of the lighting body to the socket body by in a second open position allowing a relative motion between the lighting body and the socket body only in elevation direction. This construction allows for the lighting body to be easily arranged on the socket body. In this case, azimuth direction refers to a motion around a point in the horizontal plane and elevation direction refers to a motion around a point in the vertical plane.

According to one example of the invention concerning the lighting device, the first open position relates to a first minimum distance between a longitudinal centre line of the lighting body and a longitudinal centre line of the socket body, taken at the longest distance from the first and second fastening devices. The second open position relates to a second minimum distance between the longitudinal centre line of the light fitting and the longitudinal centre line of the socket body, taken at the longest distance from the first and second fastening devices. The second minimum distance is smaller than the first minimum distance. This may also be expressed as the lighting body being in its first open position in relation to the socket body when only the first fastening device of the lighting body is interacting with the second fastening device of the socket body. The lighting body is in its second open position when the lighting body has approached the socket body and the first guiding means of the lighting body interacts with the second guiding means of the socket body. The lighting body is in the closed position in relation to the socket body when the lighting body is arranged on the socket body.

This may be clarified by specifying the three distinct positions that the lighting body may adopt in relation to the socket body as:

- a first open position which involves that at least the first fastening device of the lighting body and the second fastening device of the socket body interact so that the lighting body is guided relative to the socket body, both through a rotational motion in horizontal direction and through a rotational motion in vertical direction;
- a second open position which involves that at least the first guiding means of the lighting body and the second guiding means of the socket body interact so that the lighting body is guided relative to the socket body through a rotational motion in horizontal direction, wherein the distance between the lighting body and the socket body is smaller in the second open position than in the first open position;
- a closed position where the lighting body is substantially parallel to the socket body and the lighting body is locked to the socket body by means of the first and second locking members and further, the first electrical connection of the lighting body is connected to the second electrical connection of the socket body in order to supply the lighting body with power.

Consequently, the first open position constitutes a first phase in the assembly of the lighting body onto the socket body. The second open position arises in a later stage of the assembly of the lighting body onto the socket body, when the distance between the lighting body and the socket body is smaller than in the first open position. In the closed position, the lighting body is arranged on the socket body.

In an advantageous development of the invention, the first guiding means is comprised in the first fastening device and the second guiding means is comprised in the second fastening device.

In another advantageous development of the invention, the first and second guiding means are provided at a distance from the first and second fastening devices.

In an advantageous development of the invention, the first and second locking members are provided at a distance from the first and second fastening devices.

In further an advantageous development of the present invention, the lighting body comprises the first fastening device, where the first fastening device comprises a rear wall with an internally located contact surface. The rear wall advantageously comprises a hook portion in the lower part of the rear wall, which either consists of the rear wall being bent or one or more separate parts being arranged at the lower part of the rear wall. The rear wall may also be without a hook portion.

The lighting device further comprises a second fastening device provided on the socket body, comprising a from the socket body projecting socket part. The projecting socket part has a shape that fits well with the rear wall of the lighting body. Further, the projecting socket part may either be substantially as wide as the lighting body, as the socket body or narrower than any of these. The projecting socket part may also be composed of a plurality of projecting parts instead of one continuous part. The projecting socket part and the internally located contact surface may interact in order to form a point of contact around which the lighting body may execute a rotational motion both in azimuth direction and elevation direction relative to the socket body when the lighting body moves from the first open position to the second open position, and may execute a rotational motion in elevation direction relative to the socket body when the lighting body moves from the second open position to the closed position.

In an advantageous example of the invention, the internally located contact area of the first fastening device has a, as viewed from the lighting body, rearwardly tapering shape, and the projecting socket part of the second fastening device has a, as viewed from the socket body, rearwardly pointed shape. The rearwardly tapering shape of the first fastening device and the rearwardly pointed shape of the second fastening device are adapted to interact with each other to fit in horizontal direction and vertical direction as the lighting body is arranged against the socket body in its first open position.

In another advantageous example of the invention, two points on the lighting body interact with two points on the socket body in order to form an axis around which a relative motion in elevation direction may take place.

In one example of the invention, the lighting body comprises two lighting body points, located on either side of, and equidistant from the plane of symmetry of the lighting body. These two lighting body points are located on the inner surfaces that are formed at the inside of an upwardly tapering housing, in proximity to the first fastening device. The two lighting body points interact with two socket body points, located on either side of, and equidistant from the plane of symmetry of the socket body, located along the outer surfaces of the socket body, wherein these two lighting body points and two socket body points may interact and form a pivot axis about which a relative motion between the lighting body and the socket body only in elevation direction may take place when the lighting body is in its second open position.

In an advantageous example of the invention, the lighting body comprises the first locking member and the socket body comprises the second locking member, wherein the first locking member and/or the second locking member consist of resilient means that allow closing and opening when subjected to a predetermined load.

In an advantageous example of the invention, these resilient means are constituted by at least one metallic leaf spring. The resilient means can also be constituted by more than one leaf spring, and can be arranged substantially centrally in the width direction, the width direction being a direction perpendicular to the longitudinal direction of the lighting body also to the centre line of the lighting body, of the lighting body, shifted towards any of the edges of the illumination body, substantially parallel to the centre line of the lighting body, or symmetrically about the centre line of the lighting body.

In a possible example of the invention, the resilient means may at the arrangement of the lighting body against the socket body, when the lighting body is moved from its second open position to its closed position, bear against the socket body, whereby the resilient means exerts a force on the front abutment surface of the socket body which further locks the lighting body to the socket body in longitudinal direction.

In an advantageous example of the invention, the first guiding means is constituted by a housing having upwardly tapering upper walls, and substantially parallel lower walls, wherein the second guiding means is constituted by the to the longitudinal direction of the socket body substantially parallel outer surfaces of the socket body, which outer surfaces have upwardly tapering upper outer walls and substantially parallel lower outer walls, wherein the first guiding means is adapted to interact with the second guiding means. The interacting shapes of the first guiding means and the second guiding means, where both the first guiding means and the second guiding means have an upper part with concordantly tapering surfaces and a lower part with substantially parallel surfaces, causes the lighting body to be guided towards the socket body so that the lighting body and the socket body are substantially parallel in width direction when the lighting body moves in elevation direction from the second open position to the closed position and possibly even when the lighting body moves in elevation direction from the first open position to the second open position. The lower, substantially parallel walls of the first guiding means may also be slightly upwardly tapering and the substantially parallel lower outer walls of the second guiding means may also be slightly upwardly tapering.

In another advantageous example, the housing of the lighting body is made of aluminium or plastic, but the housing may also be made of other materials that can withstand the external stress that the lighting device is exposed to. Being able to position the lighting body correctly in relation to the socket body is in many cases a prerequisite for being able to arrange the lighting body against the socket body since it allows that the socket body is not optimally aligned to the lighting body in the initial phase of the arrangement. This is not least important in case the socket in turn is mounted on for example on a post or another not completely fixed structure and/or the lighting body is arranged on the socket body with the help of a robot or the like.

In another advantageous example, the first electrical connection comprises an earth terminal, and the second electrical connection comprises a terminal adapted to interact with the earth terminal.

In further an advantageous example of the invention, the earth terminal is provided closer to the projecting socket part of the socket body than other terminals, so that the earth terminal is connected first of all the contacts at the electrical connection of the lighting body to the socket body, and wherein the second electrical connection comprises a terminal adapted to interact with the earth terminal which is provided closer to the projecting socket part of the socket body than other terminals.

In another advantageous example of the invention, the lighting body comprises a gasket arranged around a connection recess. The gasket defines the distance between the lighting body and the socket body in the closed position of the lighting device together with the connection of the first electrical connection to the second electrical connection.

In an advantageous example of the invention, the lighting device comprises a gripping device, which is arranged on the lighting body, where the gripping device is intended for a robot to grip at mounting and dismounting of the lighting body to/from the socket body. The gripping device is arranged to allow a rotational relative motion between the lighting body and the robot both in azimuth direction and elevation direction.

At mounting and dismounting, also termed arrangement, a robot may by means of the gripping device, holding the lighting body in the gripping device, with the lighting body initially hanging substantially vertically, thanks to that the design of the gripping device allows the lighting body to move in azimuth direction and elevation direction in relation to the robot, arrange the lighting body in the first open position by a movement of the robot that brings the lighting body to the socket body in the intended manner. The fitting of the lighting body to the socket body may be enabled by the interaction of the first and the second fastening devices and/or the interaction of the first and the second guiding means.

Further, the robot may at mounting of the lighting body to the socket body, thanks to that the design of the gripping device allows the lighting body to move in azimuth direction and elevation direction in relation to the robot, move the lighting body from its first open position to its second open position by a movement of the robot, holding the lighting body. The fitting of the lighting body to the socket body is enabled at least by the interaction of the first and the second fastening devices.

Finally, during mounting the robot may, thanks to that the design of the gripping device allows the lighting body to move in elevation direction in relation to the robot, move the lighting body from its second open position to its closed position by a movement of the robot. The fitting of the lighting body to the socket body is enabled at least by the interaction of the first and the second guiding means.

Further, the lighting device may be arranged on a holder, and thus constitute a street lighting system comprising a lighting device and a holder, wherein the socket body is arranged against the holder. In an advantageous example of the invention, the holder is further arranged on a post. The holder may also be arranged on something else than a post. The inventive lighting device can also be used with other types of holders.

The socket body may further comprise means that enable adjustment of the inclination of the socket body in relation to the holder that the socket body is mounted on, which results in the possibility of adjusting the inclination of the lighting device relative to the ground plane.

The problems that are described above in the technical field are solved by using a robot especially adapted to arrange, i.e. assemble and disassemble, lighting devices arranged at height. This robot is preferably arranged on a man lift, crane or the like or on a wagon-bridge, a separate carriage or the like on a vehicle adapted for the purpose. The robot preferably comprises:

- an arm, arranged on any of the aforementioned platforms, adapted to be able to move the robot vertically, laterally, rotationally, tilting the robot etc., so that a robot head can be placed directly adjacent to the lighting device or the like to be worked,
- said robot head, arranged on the arm, comprising at least one robot arm for disassembly and/or assembly of lighting devices or the like, wherein the robot head preferably is able to rotate in order to make possible that disassembly of existing lighting device and assembly of a new lighting device can be performed in one stage,
- said, at least one, robot arm, arranged on the robot head, comprising at least one gripping device, and together with the gripping device further adapted for gripping and disassembling existing lighting devices and/or assembling new lighting devices, and said, at least one gripping device, arranged on the robot arm, adapted to be able to grip the lighting device that is to be disassembled and/or the lighting device that is to be assembled. Further, the robot preferably is remote-controlled and provided with means adapted to fix the robot to the holder from which an existing lighting device is to be disassembled/to which a new lighting device is to be assembled.

In case a robot is used to assemble and disassemble lighting devices, it is a prerequisite that the disassembly and assembly stages do not comprise many different and complicated stages since this requires far too complex robots. In addition, the components that are affected by the process ought to be relatively robust.

With the simplicity in regard of arrangement, i.e. assembly, disassembly etc., and the robustness that the inventive lighting device possesses, the inventive lighting device is optimally adapted for being combined with the concept of assembling and disassembling lighting devices by using a robot.

Lighting devices that are simple and quickly disassembled and assembled are advantageous also in the case when the assembly/disassembly is performed by a person, but an additional advantage of using some kind of robot adapted for the purpose for performing the work, contrary to a person performing the work, is that there is not the same need to earth the lighting device if a robot performs the work.

The above mentioned examples can be combined freely, but can also occur separately.

BRIEF DESCRIPTION OF THE DRAWINGS

The invention will be described in greater detail in the following, with reference to the figures, wherein.

DETAILED DESCRIPTION OF THE INVENTION

The following described examples of the invention are only to be regarded as examples and should in no way be limiting to the scope of the claims. Thus, the examples are not to be interpreted restrictively. Components may be part of the invention even if not exposed in the following figures.

Figure 1:
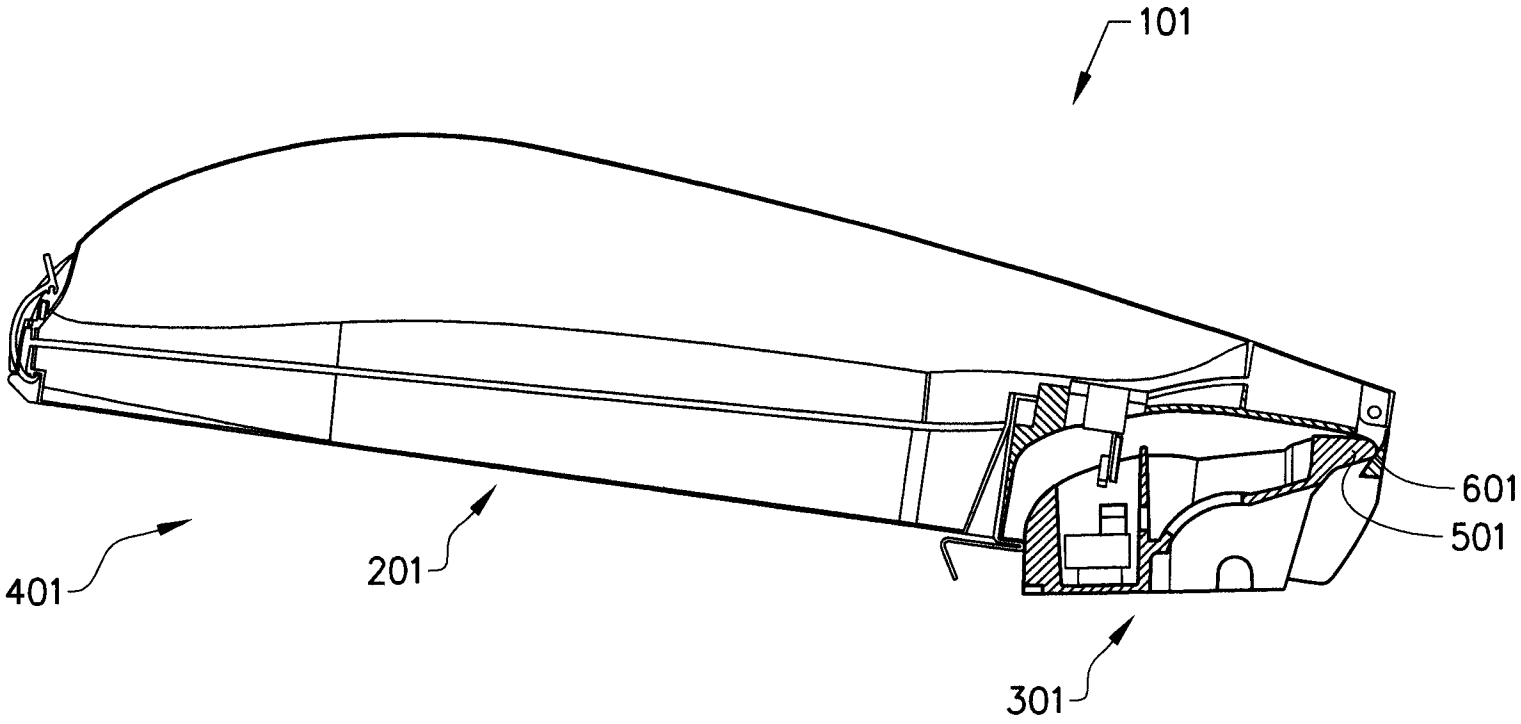
FIG. 1 shows a schematic example of a lighting device according to the invention.

FIG. 1 shows an example of an inventive lighting device 101, comprising a lighting body 201 and a socket body 301 in cross-section. FIG. 1 shows the lighting body when in a second open position 401, where the first guiding means of the lighting body 201 and a second guiding means of the socket body 301 interact in order to guide the lighting body 201 towards the socket body 301 in elevation direction. Furthermore, FIG. 1 shows how the projecting socket part 501 of the socket body 301 interacts with the internally located contact surface 601 of the lighting body 201 and forms a point of contact around which the lighting body 201 can move in elevation direction relative to the socket body 301.

In FIG. 1, arrows are showing the movement in elevation direction with alfa $\alpha$ and movement in longitudinal direction with LL.

Figure 2:
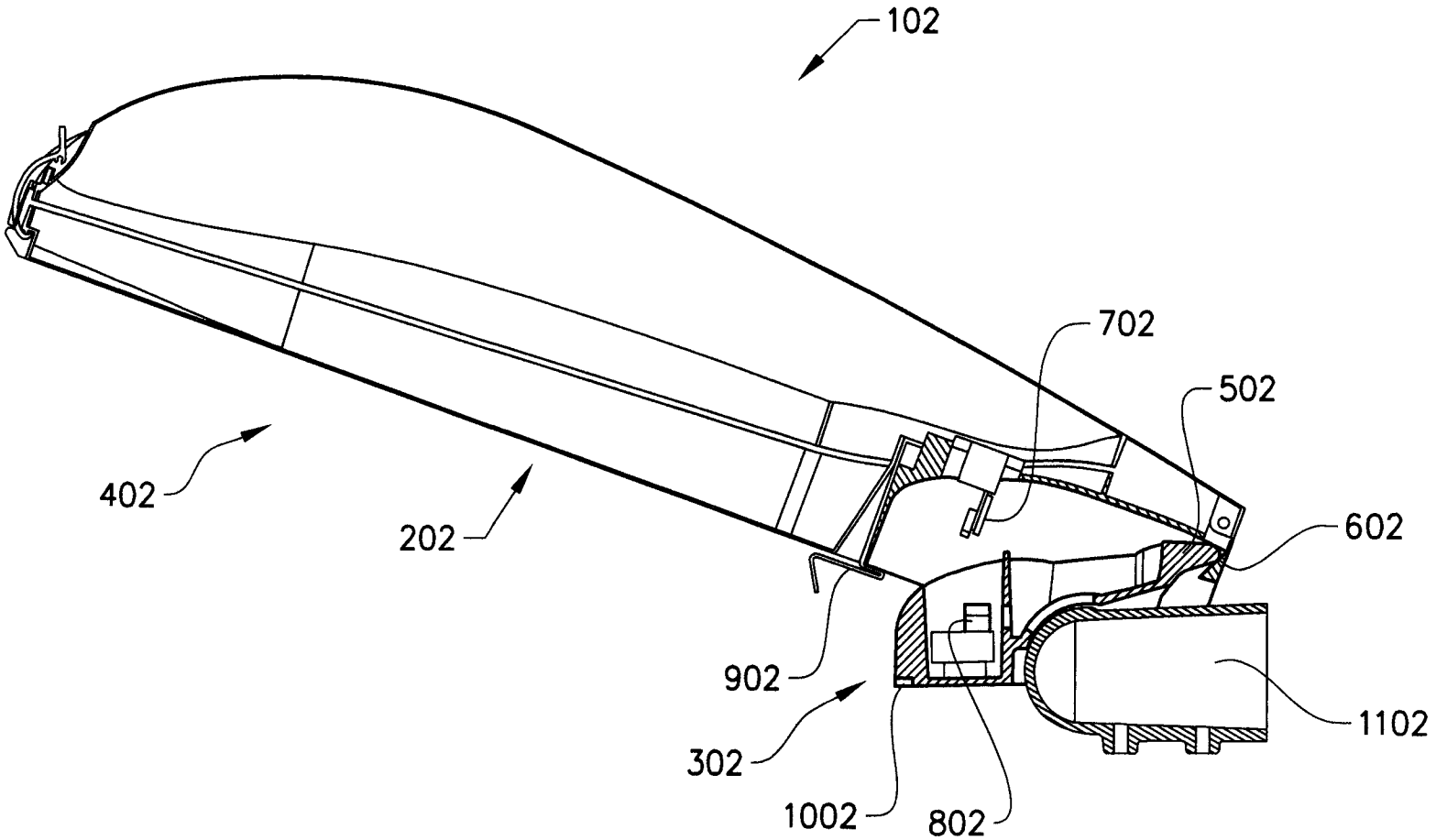
FIG. 2 shows another schematic example of a lighting device according to the invention.

FIG. 2 shows another example of an inventive lighting device 102, comprising a lighting body 202 and a socket body 302 in cross-section. FIG. 2 shows the lighting body 202 when in a second open position 402, where the first guiding means of the lighting body 202 and the second guiding means of the socket body 302 interact in order to guide the lighting body 202 towards the socket body 302 in elevation direction. Furthermore, FIG. 2 shows how the projecting socket part 502 of the socket body 302 according to the example interacts with the internally located contact surface 602 of the lighting body 202 and forms a point of contact around which the lighting body 202 can move in elevation direction relative to the socket body 302. Furthermore, the example of FIG. 2 shows how the first electrical connection 702 of the lighting body 202 is about to be connected to a second electrical connection 802 arranged on the socket body 302. In FIG. 2 can also be seen a first locking member 902 arranged on the lighting body 202, in this case in the form of a leaf spring, and a second locking member 1002 arranged on the socket body 302, in this example in the form of a in the socket body arranged recess adapted to interact with the first locking member 902 in order to lock the lighting body 202 to the socket body 302 when the lighting body 202 is in its closed position. This is just an example of how the interacting first and second locking members 902; 1002 may be designed, and an example of how the interacting first and second electrical connections 702; 802 can be designed. Furthermore, FIG. 2 shows how the socket body 302 is arranged on an example of a holder 1102.

Figure 3:
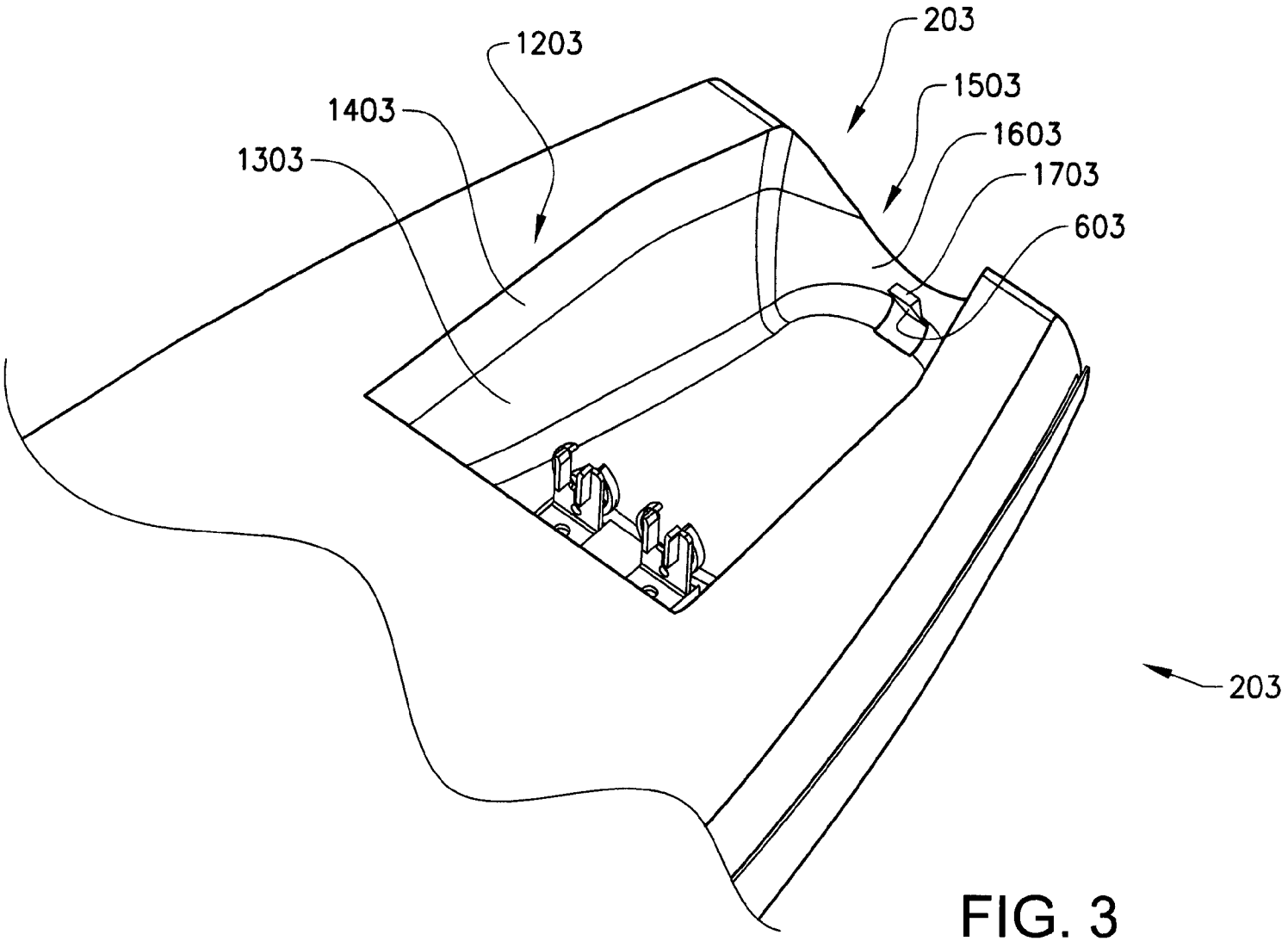
FIG. 3 shows a schematic example of a lighting body viewed obliquely from below according to the invention.

FIG. 3 shows an example of an inventive lighting body 203 viewed obliquely from below. In the example of FIG. 3, a first guiding means 1203 with upwardly tapering upper walls 1303 and lower substantially parallel walls 1403 is shown. In the example, the rear wall 1603 of the first fastening device 1503 is further shown. In the example according to FIG. 3, a hook portion 1703 is arranged on the lower part of the rear wall 1603. Furthermore, the hook portion 1703 is placed centrally according to FIG. 3, but the hook portion 1703 may also be in the form of one or several portions, placed centrally or symmetrically on the rear wall 1603, or in the form of a continuous flange. Furthermore, the internally located contact surface 603 is shown above the hook portion 1703.

Figure 4:
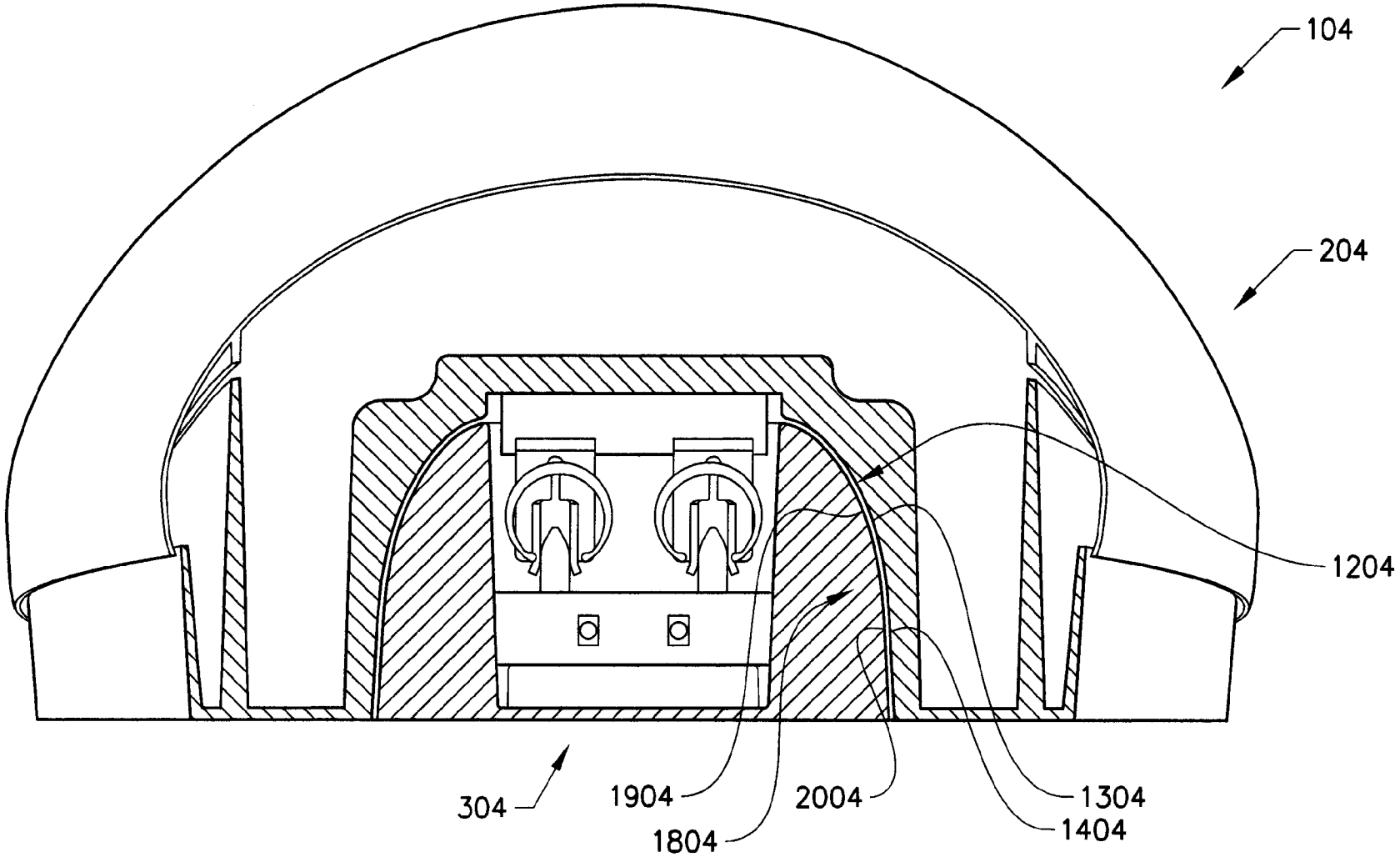
FIG. 4 shows a schematic example of the invention in cross-section from behind.

FIG. 4. shows a cross-section of an example of the lighting device 104 where the lighting body 204 is arranged on the socket body 304. Furthermore, FIG. 4 shows how the first guiding means 1204 of the lighting body 204 comprises upwardly tapering upper walls 1304. In the example of FIG. 4, the lower walls 1404 of the first guiding means are also upwardly tapering, but in another example of the invention, these walls can be substantially parallel. Furthermore, the second guiding means 1804 of the socket body 304 are shown. Said second guiding means 1804 comprises upwardly tapering upper outer walls 1904 and substantially parallel lower outer walls 2004. In the example of FIG. 4, the lower outer walls 2004 of the second guiding means are upwardly tapering, but in another example of the invention, they may also be substantially parallel. The first guiding means 1204 of the lighting body 204 is adapted to fit to the second guiding means 1804 of the socket body 304 so that the upwardly tapering upper outer walls 1904 and the lower outer walls 2004 of the second guiding means 1804 interacts with the upwardly tapering upper walls 1304 and lower walls 1404 of the first guiding means 1204, and thus contributes to guiding the lighting body 204 towards the socket body 304 especially in horizontal direction at least when the lighting body 204 moves from a second open position to a closed position by allowing a relative motion between the lighting body 204 and the socket body 304 only in elevation direction.

Figure 5:
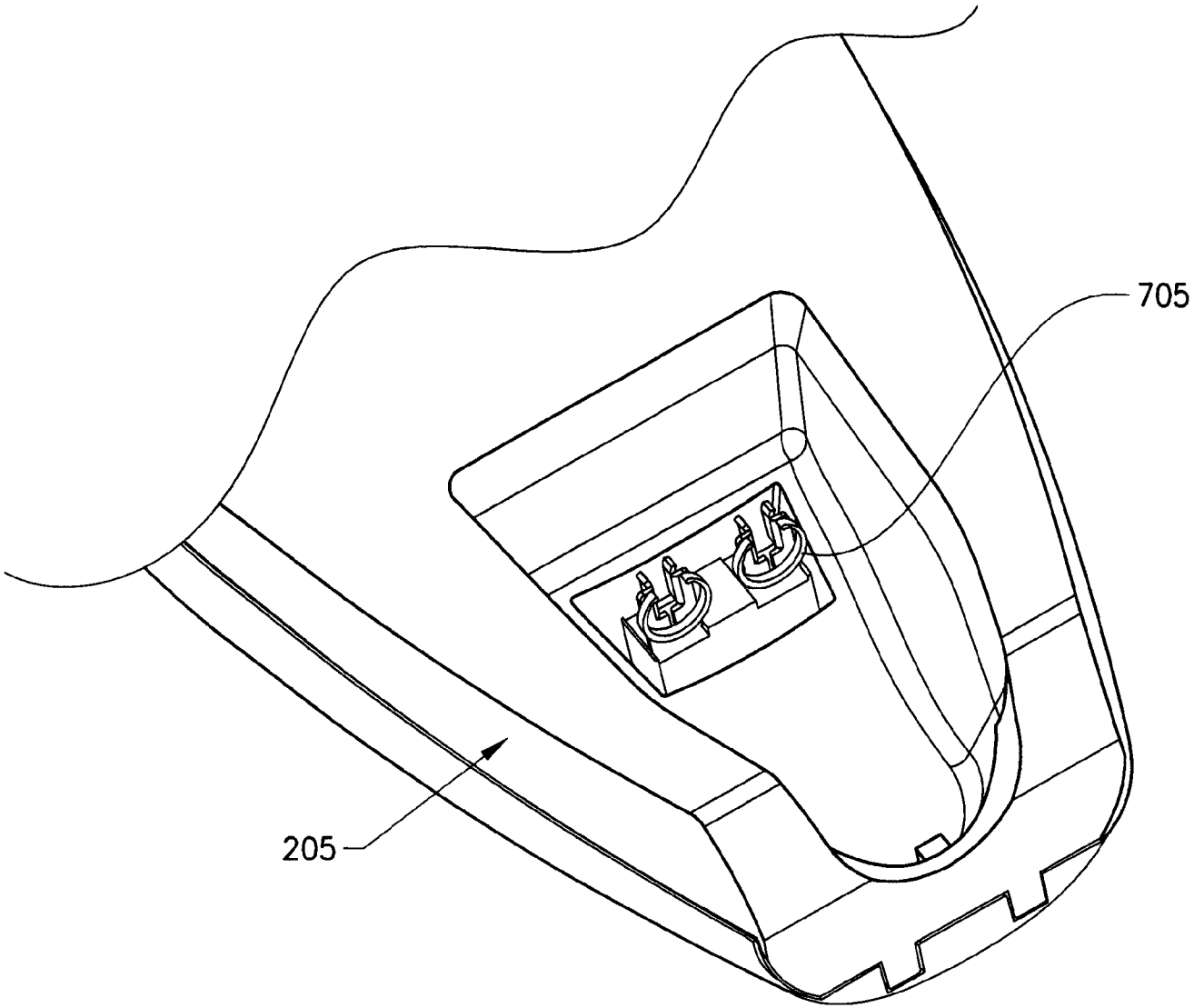
FIG. 5 shows a schematic example of an inventive lighting body from below.

In FIG. 4, arrows are showing the movement in azimuth direction by the angle beta β. FIG. 5 shows an example of a lighting body 205 seen from below, wherein a first electrical connection 705 is arranged on the lighting body 205. In the example of FIG. 5, the first electrical connection 705 has two terminals, but the first electrical connection 705 may also comprise more terminals depending on which functions the lighting device is equipped with. The first electrical connection 705 is arranged to be able to interact with a second electrical connection, arranged on the socket body.

Figure 6:
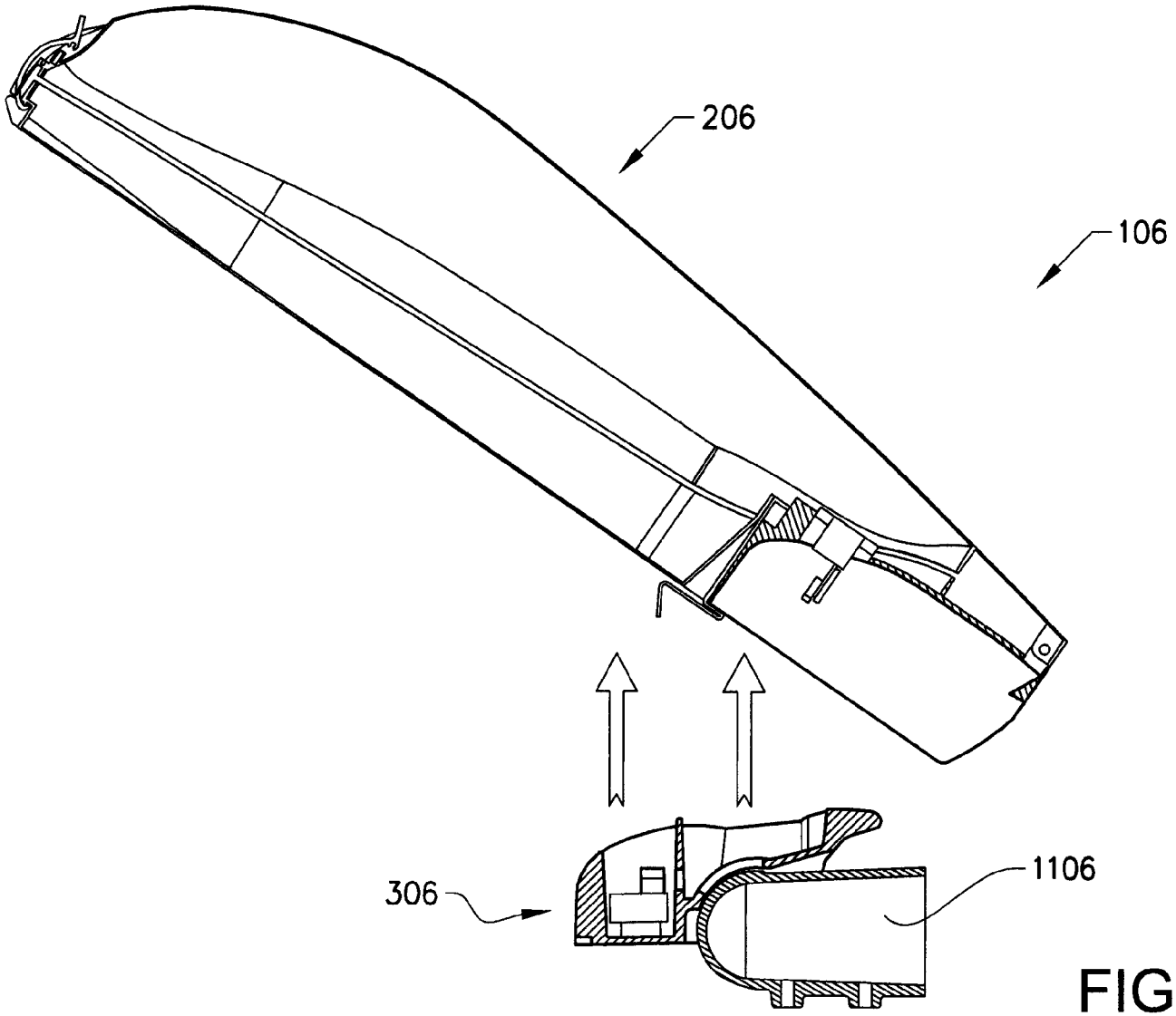
FIGS. 6, 7, 8, 9, and 10 show schematically a sequence of how an example of a lighting body is arranged on a socket body according to the invention.

FIG. 6 shows an example where a lighting body 206 is about to be arranged on a socket body 306, where the socket body 306 further is arranged on a holder 1106. FIG. 6 shows the lighting device 106, with constituent parts, in cross-section.

Figure 7:
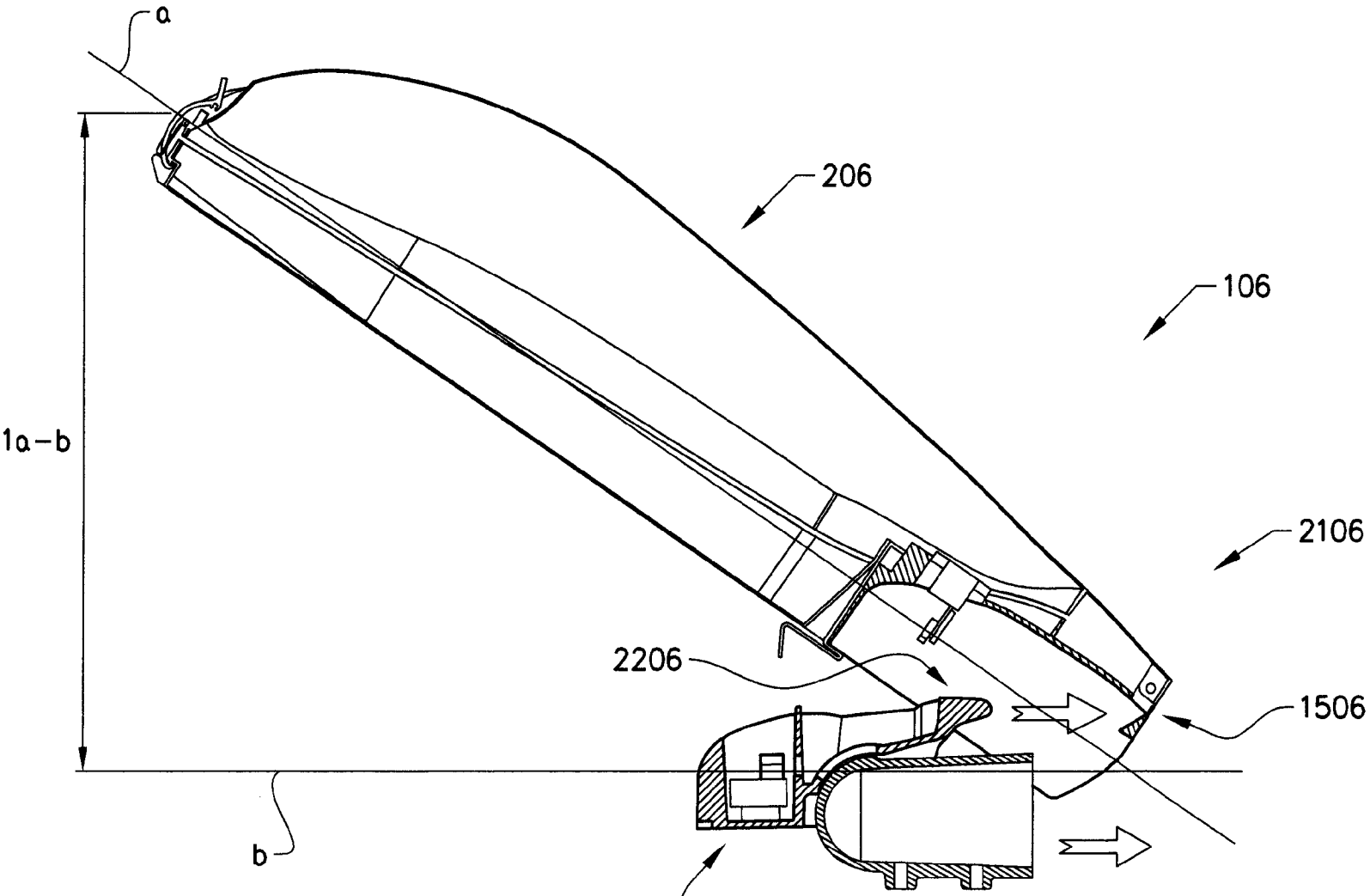

FIG. 7 shows how the lighting body 206 according to FIG. 6 is about to be arranged in a first open position 2106. At the fitting of the lighting body 206 to the socket body 306 at this stage of the arrangement of the lighting body 206 to the socket body 306, the first fastening device 1506 of the lighting body 206 interacts with the second fastening device 2206 of the socket body 306 so that the lighting body 206 is corrected in lateral and longitudinal direction relative to the socket body 306. FIG. 7 shows the lighting device 106, with constituent parts, in cross-section.

Furthermore, in FIG. 7 can be seen a marked centre line of the lighting body a and a centre line of the socket body b. The distance between the longest distance along the centre line of the lighting body a and the first fastening device 1506 and the longest distance along the centre line of the socket body and the second fastening device 2206 provides a first minimum distance 1*a-b*.

Figure 8:
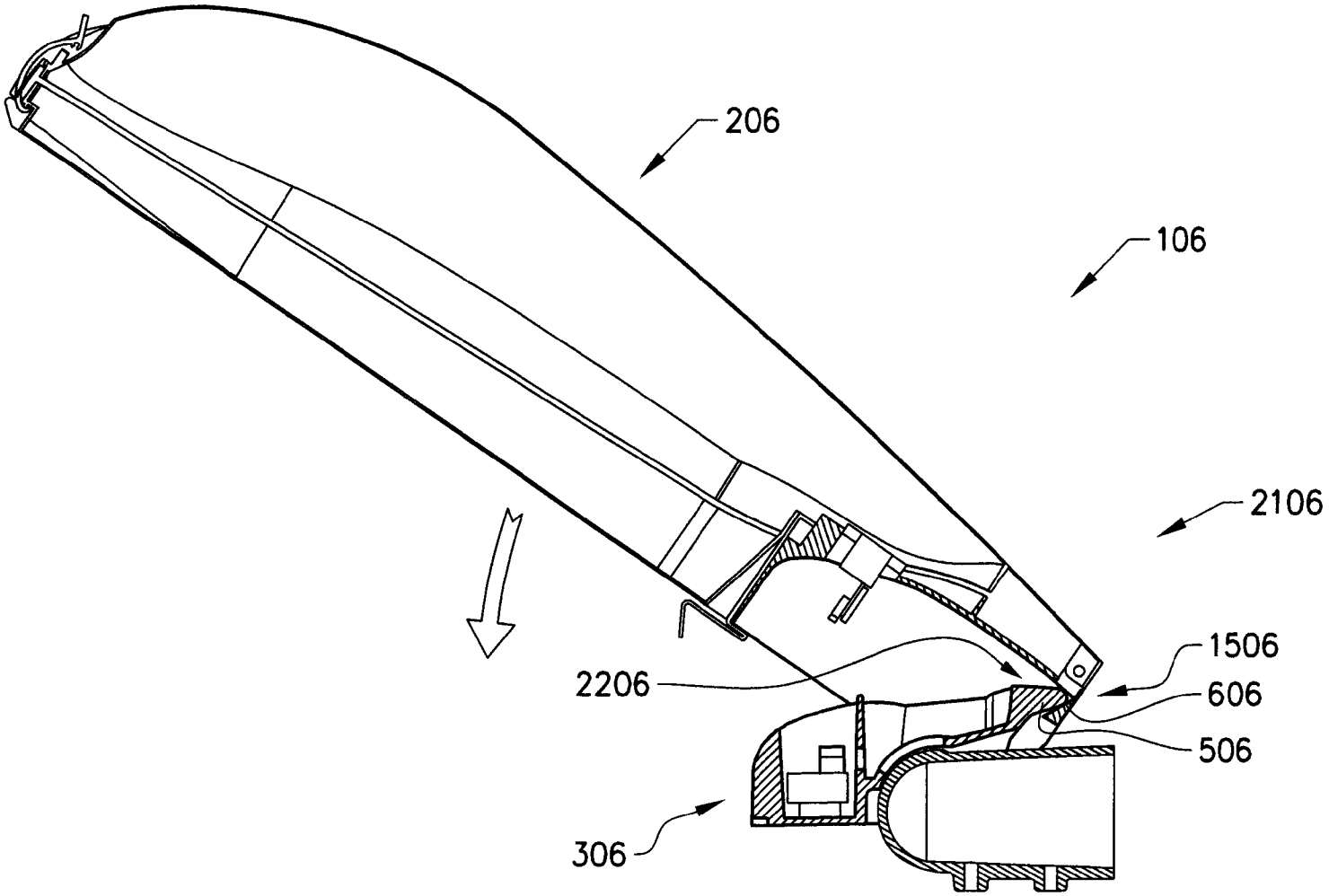

FIG. 8 shows how the lighting body 206 according to FIG. 6 and FIG. 7 is in a first open position 2106. In this first open position 2106, the internally located contact surface 606 of the lighting body 206 bears against the projecting socket part 506 of the socket body 306, which means that the first fastening device 1506 of the lighting body 206 interacts with the second fastening device 2206 of the socket body 306, which allows a rotational relative motion between the lighting body 206 and the socket body 306 both in azimuth direction and elevation direction and simultaneously locks a relative motion between the lighting body 206 and the socket body 306 in longitudinal direction. FIG. 8 shows the lighting device 106, with constituent parts, in cross-section.

Figure 9:
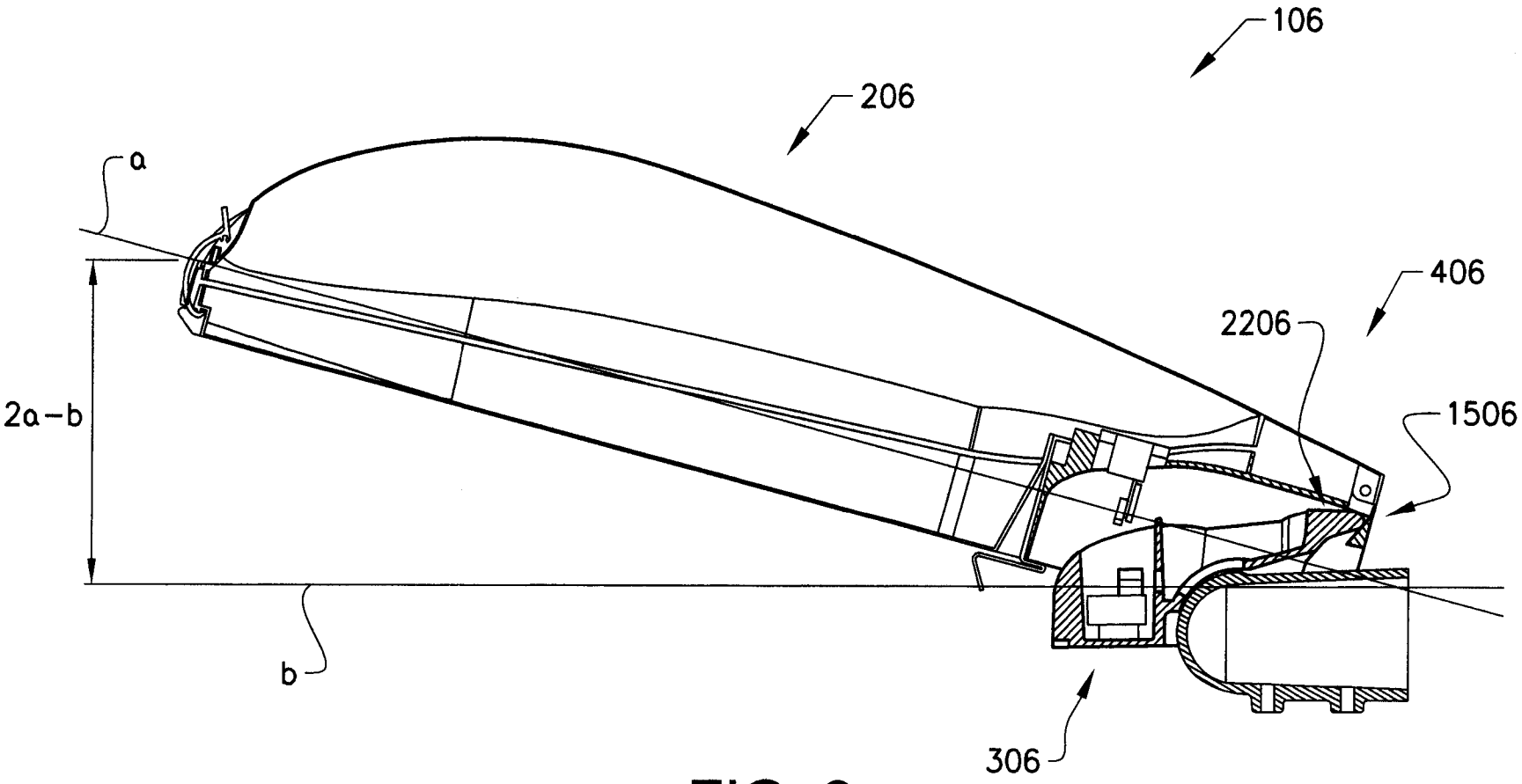

FIG. 9 shows how the lighting body 206 according to FIG. 6, FIG. 7, and FIG. 8 is in a second open position 406. When the lighting body 206 moves from the first open position to the second open position 406, the distance between the lighting body 206 and the socket body 306 being smaller in the second open position 406 than in the first open position, the first guiding means of the lighting body 206 interacts at least with the second guiding means of the socket body 306 as to correct the lighting body 206 in horizontal direction relative to the socket body 306. FIG. 9 shows the lighting device 106, with constituent parts, in cross-section.

Furthermore, in FIG. 9 can be seen a marked centre line of the lighting body a and a centre line of the socket body b. The distance between the longest distance along the centre line of the lighting body a and the first fastening device 1506 and the longest distance along the centre line of the socket body and the second fastening device 2206 provides a second minimum distance 2*a-b*.

Figure 10:
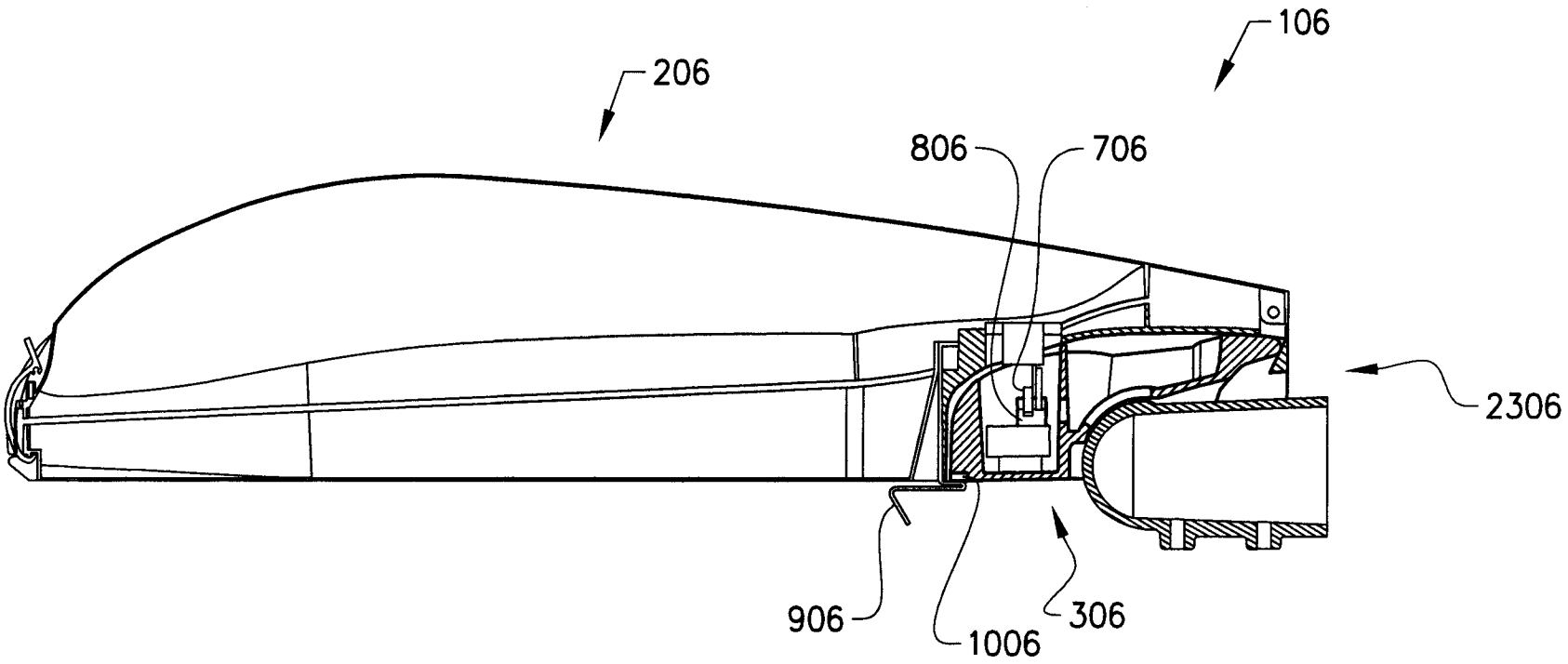

FIG. 10 shows how the lighting body according to FIG. 6, FIG. 7, FIG. 8, and FIG. 9 is in a closed position 2306. Furthermore, FIG. 10 shows how the first electrical connection 706 of the lighting body 206 is connected to the second electrical connection 806 of the socket body, and how the first locking member 906 of the lighting body 206 of this example of the inventive lighting device 106 is interlocked with the second locking member 1006 of the socket body 306 of this example of the inventive lighting device 106. In the example according to FIG. 6, FIG. 7, FIG. 8, FIG. 9, and FIG. 10, the first locking member 906 is in the form of a from the lighting body 206 projecting resilient flange, and the second locking member 1006 is only in the form of a on the socket body 306 situated contact surface which the first locking member may bear against, but also other constructions of the first locking member and the second locking member are possible. FIG. 10 shows the lighting device 106, with constituent parts, in cross-section.

Figure 11:
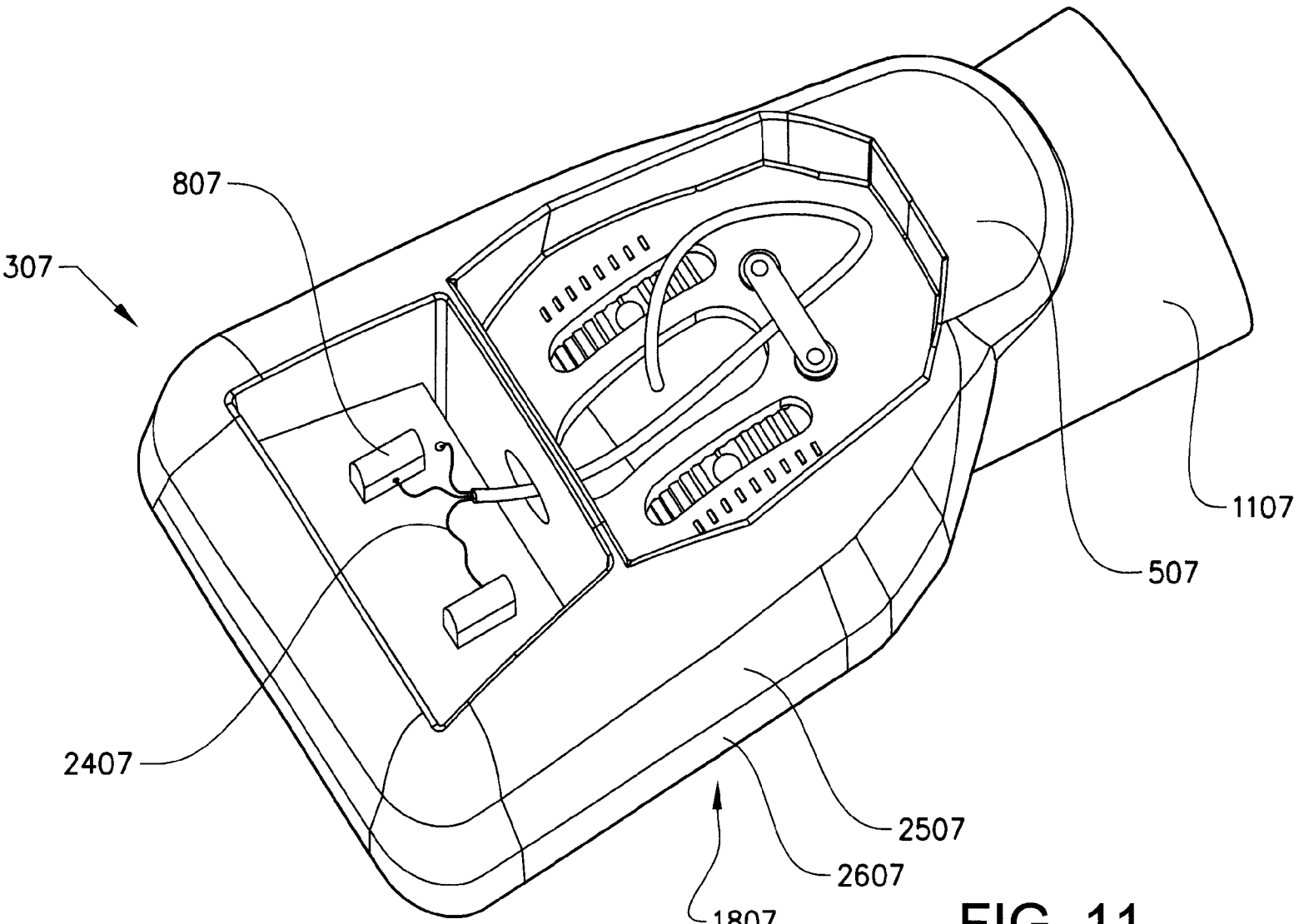
FIG. 11 shows a schematic example of a socket body according to the invention.

FIG. 11 shows an example of a socket body 307 seen from above, wherein the socket body 307 according to the example is arranged on a holder 1107. Furthermore, FIG. 11 shows an example of the projecting socket part 507 of the socket body 307 and the second electrical connection 807 of the socket body 307. In the example according to FIG. 11, the second electrical connection 807 has two terminals, but the second electrical connection 807 may also comprise more terminals depending on which functions the lighting device is equipped with. The second electrical connection 807 is arranged to be able to interact with a first electrical connection, arranged on the lighting body. It is also shown how the second electrical connection 807 is connected to cables 2407 and that one cable is earthed. In addition, FIG. 11 shows that the socket body 307 has upwardly tapering upper outer walls 2507 and lower outer walls 2607, which are part of the second guiding means 1807 of the socket body 307 exhibited in FIG. 11. In the example according to FIG. 11 are also the lower outer walls 2607 upwardly tapering, but in other examples of the inventive lighting device, these can be substantially parallel.

Figure 12:
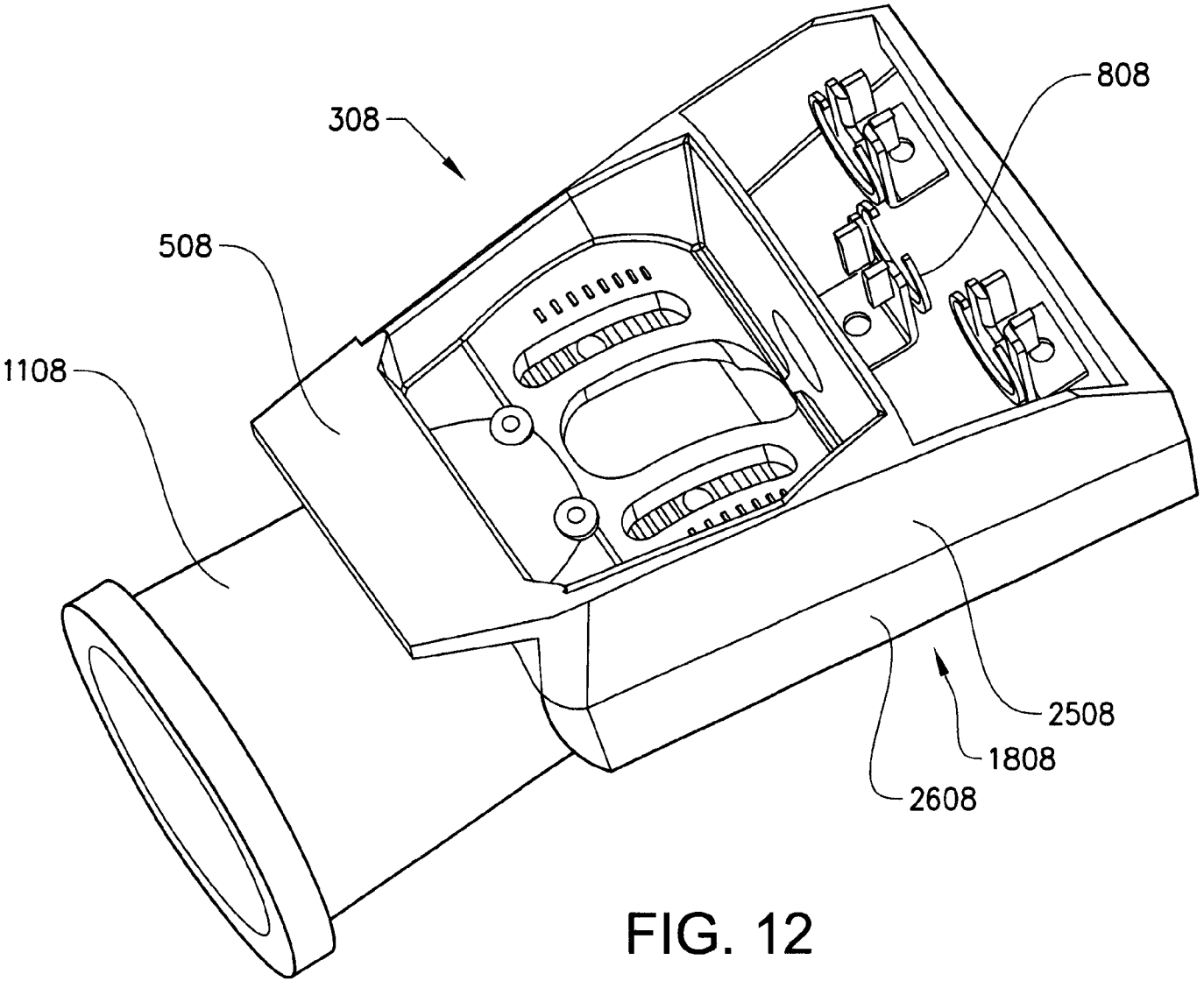
FIG. 12 shows another schematic example of a socket body according to the invention.

FIG. 12 shows another example of a socket body 308 seen from above, wherein the socket body 308 according to the example is arranged on a holder 1108. Further, FIG. 12 shows another example of the projecting socket part 508 of the socket body 308 and the second electrical connection 808 of the socket body 308. In the example according to FIG. 12, the second electrical connection has three terminals. In addition, FIG. 12 shows that the socket body 308 has upwardly tapering upper outer walls 2508 and lower outer walls 2608, which are part of the in FIG. 12 exhibited second guiding means 1808 of the socket body 308. In the example according to FIG. 12 are also the lower outer walls 2608 upwardly tapering, but in other examples of the inventive lighting device, these can be substantially parallel.

REFERENCE SIGNS

101-104, 106 lighting device
201-206 lighting body

301-302, 304, 306-308 socket body
401-402, 406 second open position
501-502, 506-508 projecting socket part
601-603, 606 internally located contact surface
702, 705-706 first electrical connection
802, 806-808 second electrical connection
902, 906 first locking member
1002, 1006 second locking member
1102, 1106-1108 holder
1203-1204 first guiding means
1303-1304 upper walls
1403-1404 lower walls
1503, 1506 first fastening device
1603 rear wall
1703 hook portion
1804, 1807-1808 second guiding means
1904 upper outer walls
2004 lower outer walls
2106 first open position
2206 second fastening device
2306 closed position
2406 cables
2507-2508 upper outer walls
2607-2608 lower outer walls
1*a-b* first minimum distance
a centre line of the lighting body
2*a-b* second minimum distance
b centre line of the socket body

The invention claimed is:

1. A lighting device for outside use comprising a lighting body and a socket body, the lighting body comprising an lighting unit, a first electrical connection and a first locking member, the socket body comprising a second electrical connection and a second locking member, wherein the first and second electrical connections are arranged to connect to each other in a closed position in order to supply the lighting unit with power and wherein the first locking member and the second locking member are arranged for locking and unlocking the lighting body to the socket body in said closed position wherein the lighting body comprises a first fastening device comprising a rear wall having an internally located contact surface, and the socket body comprises a second fastening device comprising a projecting socket part, wherein the internally located contact surface and the projecting socket part interact to form a point of contact during connection of the lighting body to the socket body, wherein the first and second fastening devices are arranged to interact in the point of contact during connection of the lighting body to the socket body by in a first open position allowing a rotational relative motion between the lighting body and the socket body around the point of contact both in azimuth direction and elevation direction and by the point of contact simultaneously locking a relative motion between the lighting body and the socket body in a longitudinal direction, and wherein the lighting body comprises a first guiding member and the socket body comprises a second guiding member, which first and second guiding member are arranged to interact at least at connection of the lighting body to the socket body in a second open position allowing a relative motion between the lighting body and the socket body only in elevation direction around the point of contact, wherein the second open position is more closed than the first open position.

2. A lighting device according to claim 1, wherein the first guiding member is comprised in the first fastening device and the second guiding member is comprised in the second fastening device.

3. A lighting device according to claim 1, wherein the first and second guiding members are provided at a distance from the first and second fastening devices.

4. A lighting device according to claim 1, wherein the first and second locking members are provided at a distance from the first and second fastening devices.

5. A lighting device according to claim 1, comprising the lighting body which comprises the first locking member, and where the lighting device further comprises the socket body which comprises the second locking member, wherein the first locking member and/or the second locking member consist of a resilient member that allow closing and opening when subjected to a predetermined load.

6. A lighting device according to claim 1, wherein the first guiding member is constituted by a housing having upwardly tapering upper walls, and lower substantially parallel lower walls, wherein the second guiding member is constituted by to the longitudinal direction of the socket body substantially parallel outer surfaces of the socket body, which outer surfaces have upwardly tapering upper outer walls and lower substantially parallel lower outer walls, wherein the first guiding member is adapted to interact with the second guiding member.

7. A lighting device according to claim 1, wherein the housing of the lighting body is made of aluminum or plastic.

8. A lighting device according to claim 1, wherein the first electrical connection comprises an earth terminal, and the second electrical connection comprises a terminal adapted to interact with the earth terminal.

9. A lighting device according to claim 8, wherein the earth terminal is provided closer to the projecting socket part of the socket body than other terminals, so that the earth terminal is connected first of all the contacts at the electrical connection of the lighting body to the socket body, and wherein the second electrical connection comprises a terminal adapted to interact with the earth terminal provided closer to the projecting socket part of the socket body than other terminals.

10. A street lighting system comprising a lighting device according to claim 1 wherein the system comprises a holder arranged against the socket body.

11. A street lighting system according to claim 10, in which the holder further is arranged on a lamp post.

12. A lighting device according to claim 1, further comprising a gripping device, wherein the gripping device is arranged on the lighting body, where the gripping device is intended for a robot to grip at mounting and dismounting of the lighting body to/from the socket body, wherein the gripping device is arranged to allow a rotational relative motion between the lighting body and the robot both in azimuth direction and elevation direction.

13. A lighting device according to claim 1, wherein the internally located contact surface has a rearwardly tapering shape.

14. A lighting device according to claim 1, wherein the projecting socket has a rearwardly pointed shape.

15. A method for assembling a lighting device for outside use comprising a lighting body and a socket body, the lighting body comprising an lighting unit, a first electrical connection and a first locking member, the socket body comprising a second electrical connection and a second locking member, wherein the first and second electrical connections connects to each other in a closed position in order to supply the lighting unit with power and further wherein the first locking member and the second locking member locks and unlocks the lighting body to the socket body in said closed position wherein the lighting body is moved against the socket body wherein the lighting body comprises a first fastening device comprising a rear wall having an internally located contact surface, and the socket body comprises a second fastening device comprising a projecting socket part, wherein the internally located contact surface and the projecting socket part interact to form a point of contact during connection of the lighting body to the socket body, wherein the first and second fastening devices interact in the point of contact during connection of the lighting body to the socket body by in a first open position allowing a rotational relative motion between the lighting body and the socket body around the point of contact both in azimuth direction and elevation direction and by the point of contact simultaneously locking a relative motion between the lighting body and the socket body in a longitudinal direction, wherein the lighting body comprises a first guiding member and the socket body comprises a second guiding member, which first and second guiding members interact at connection of the lighting body to the socket body when the lighting device is moved from a second open position to the closed position by allowing a relative motion between the lighting body and the socket body only in elevation direction around the point of contact, wherein the second open position is more closed than the first open position, the method comprising:

placing the lighting body and the socket body into the first open position;

placing the lighting body and the socket body into the second open position following the first open position; and placing the lighting body and the socket body into the closed position following the second open position.

* * * * *